US007837507B1

(12) United States Patent
Yang et al.

(10) Patent No.: US 7,837,507 B1
(45) Date of Patent: Nov. 23, 2010

(54) CONNECTOR WITH TWO PIECE SHELLS

(75) Inventors: Chih-Ling Yang, Tu-Cheng (TW); Hsin-Tsung Ho, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 28 days.

(21) Appl. No.: 12/453,080

(22) Filed: Apr. 29, 2009

(51) Int. Cl.
*H01R 13/648* (2006.01)

(52) U.S. Cl. ..... 439/607.31; 439/607.04

(58) Field of Classification Search ..... 439/607.31, 439/607.27, 607.34–38, 607.04–607.09, 439/660
See application file for complete search history.

(56) References Cited

U.S. PATENT DOCUMENTS 7,402,078 B2 * 7/2008 Wan et al. ..... 439/607.01
7,402,080 B2 * 7/2008 Xiao et al. ..... 439/607.2
7,485,008 B1 * 2/2009 Yi et al. ..... 439/660
2009/0298336 A1 * 12/2009 Xiong et al. ..... 439/607.01
2010/0075542 A1 * 3/2010 Ho ..... 439/660

* cited by examiner

*Primary Examiner*—T C Patel
*Assistant Examiner*—Phuong Nguyen
(74) *Attorney, Agent, or Firm*—Rosenberg, Klein & Lee

(57) ABSTRACT

A connector connected with a complementary component inserted therein from a front direction includes an insulating housing and a shield coupled with the insulating housing comprising an upper shell and a lower shell. The upper shell has an upper cover covering a top surface of the insulating housing and a pair of wings extending laterally from two opposite sides of the upper cover. The wing has a slot extending along a front-to-rear direction, and a plurality of positioning pegs extended downwards from a lateral edge thereof. The lower shell has a lower cover and two lateral plates bent upwards from two opposite sides of the lower cover and flanked to the insulating housing. Each of the lateral plates has a clasper which passes through the slot of the wing and extends laterally to hook a side of the slot, for buckling the upper shell with the lower shell together.

9 Claims, 6 Drawing Sheets

CONNECTOR WITH TWO PIECE SHELLS

BACKGROUND OF THE INVENTION

1. Field of the Invention

The present invention generally relates to a connector, and more particularly to a connector having a shield adapted for preventing electro magnetic interference.

2. The Related Art

A connector mounted to an electrical device for transmitting signal is required to equipped with a shield for preventing electro magnetic interference (EMI). FIG. 9 is a perspective view illustrating a connector with shielding function in prior art. The connector 200 generally involves an insulating housing 6, a plurality of terminals 7 mounted in the insulating housing 6 and a shield 8 coupled with the insulating housing 6. The shield 8 is formed integrally to enclose the insulating housing 6. A stopping portion 61, which is extended outwards and bent frontward from a rear end of each of two lateral sides of the insulating housing 6, is positioned outside the shield 8 when the shield 8 is assembled to the insulating housing 6, for restricting the shield 8. Two lateral surfaces of the shield 8 are punched to form supporting slices 81 extending outwards at a front thereof, and strip positioning pegs 82 at a rear thereof. The positioning peg 82, which is bent to show an inverted-L shape, encloses the stopping portion 61 and exceeds a bottom of the connector 200 for mounting in appropriate mounting holes of a printed circuit board (not visible in the appended drawing). However, since the shield 8 made of metal plate is punched with a plurality of openings for forming the supporting slices 81 and the positioning pegs 82, it is inclined to generate EMI problem because the shield 8 is unable to shield the insulating housing 6 completely.

SUMMARY OF THE INVENTION

An object of the present invention is to provide a connector having a shield with excellent shielding function. The connector is adapted for electrically connecting with a complementary component inserted therein from a front direction, and includes an insulating housing having a basic body, a plurality of terminals received in the insulating housing, and a shield coupled with the insulating housing comprising an upper shell and a lower shell. The upper shell has an upper cover covering a top surface of the insulating housing and a pair of wings extending laterally from two opposite sides of the upper cover. Each of the wings has at least one slot extending along a front-to-rear direction and adjacent to the upper cover, and a plurality of positioning pegs extended downwards from a lateral edge thereof. The lower shell has a lower cover attached to a bottom surface of the basic body and two lateral plates extended upwards from two opposite sides of the lower cover and flanked to the insulating housing. Each of the lateral plates has at least one clasper which passes through the slot of the wing and extends laterally to hook a side of the slot, for buckling the upper shell with the lower shell together.

As described above, the shield is formed by the upper shell and the lower shell. The upper shell has the upper cover covering the insulating housing and wings exceeding the insulating housing. The lower shell has the lateral plates flanked to the insulating housing and buckling with the upper shell by the claspers hooking the sides of the slots formed on the wings. Furthermore, the positioning pegs are arranged at the sides of the wings. Such structure of the shield is capable of completely coating the insulating housing, without punching openings on the portion attached to the insulating housing for achieving supporting and positioning function. Therefore, the shield is preferable to prevent the connector from EMI problem.

BRIEF DESCRIPTION OF THE DRAWINGS

The present invention will be apparent to those skilled in the art by reading the following description thereof, with reference to the accompanying drawings, in which.

DETAILED DESCRIPTION OF THE EMBODIMENTS

Figure 1:
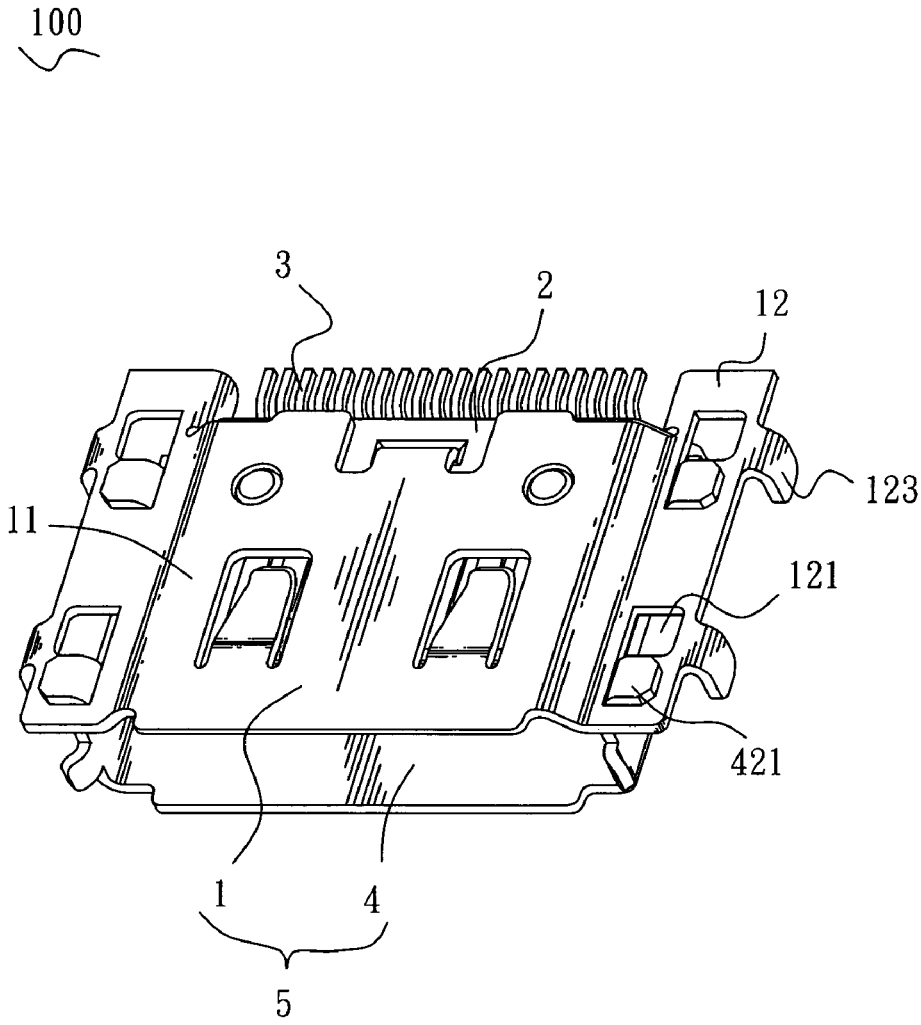
FIG. 1 is an assembled, perspective view of a connector of a first embodiment according to the present invention.
Figure 2:
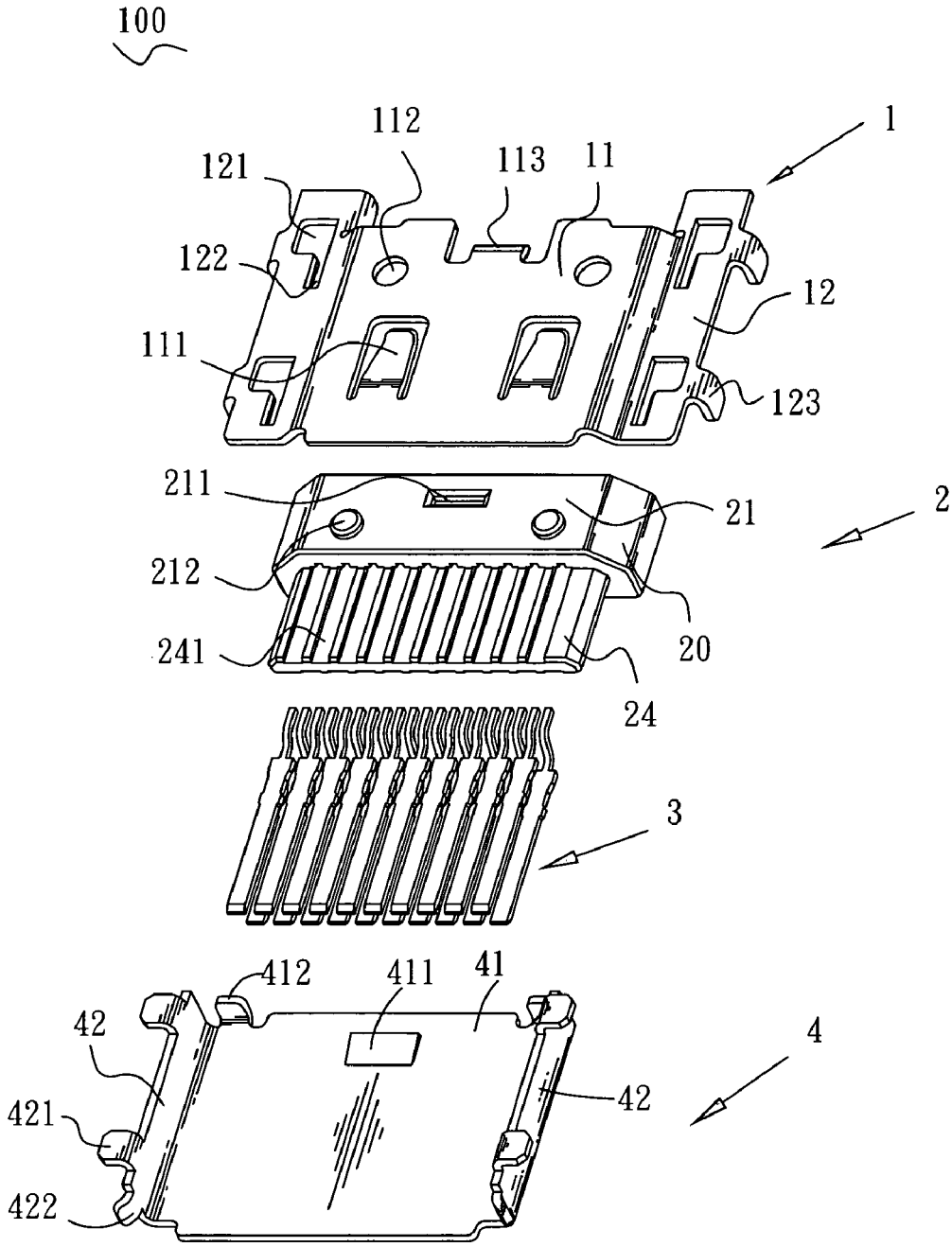
FIG. 2 is an exploded, perspective view of the connector shown in FIG. 1.
Figure 3:
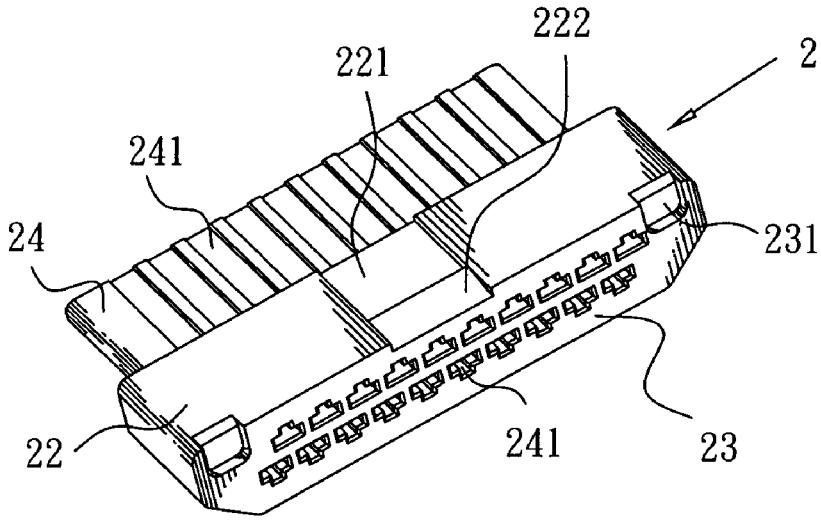
FIG. 3 is a perspective view of an insulating housing of the connector shown in FIG. 2 seen from a rear and bottom angle.

With reference to FIGS. 1-3, a connector 100 of the first embodiment mounted on a printed circuit board (PCB, not shown) includes an insulating housing 2, a plurality of terminals 3 received in the insulating housing 2 and a shield 5 coupled with the insulating housing 2. The insulating housing 2 has a substantially rectangular basic body 20. The basic body 20 defines a top surface 21, a bottom surface 22, and a rear surface 23. The top surface 21 has a restraining slot 211 extending leftwards and rightwards at a substantially middle portion thereof along a left-to-right direction, adjacent to the rear surface 23, and two circle protrusions 212 disposed at two ends thereof along the left-to-right direction, away from the rear surface 23. The bottom surface 22 has a buckling groove 221 extending frontward and rearwards at middle thereof and passing through a front thereof, and a wedge-shaped stopper 222 located at a rear end of the buckling groove 221. The rear surface 23 is recessed inwards to form two recesses 231 at two ends thereof along the left-to-right direction, passing through the bottom surface 22. A front of the basic body 20 opposite to the rear surface 23 is projected to form an insert section 24 of rectangular plate-like shape, with a peripheral dimension thereof less than that of the basic body 20. The insert section 24 is formed with a plurality of terminal grooves 241 extending from a front thereof to reach the rear surface 23, for receiving the terminals 3.

Figure 4:
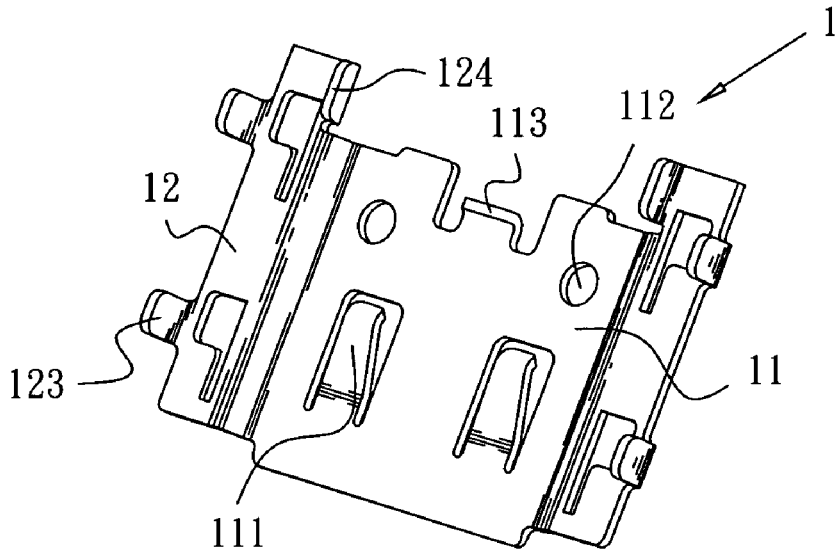
FIG. 4 is a perspective view of an upper shell of a shield of the connector shown in FIG. 2 seen from a bottom angle.
Figure 5:
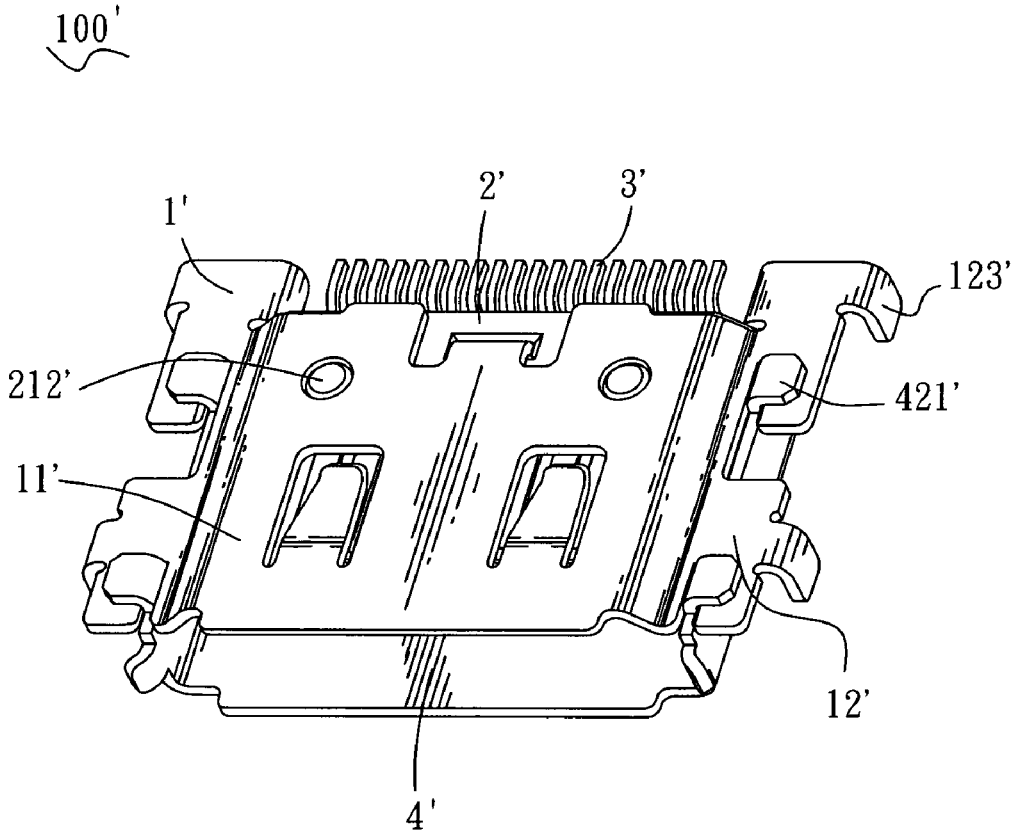
FIG. 5 is an assembled, perspective view of a connector of a second embodiment according to the present invention.
Figure 6:
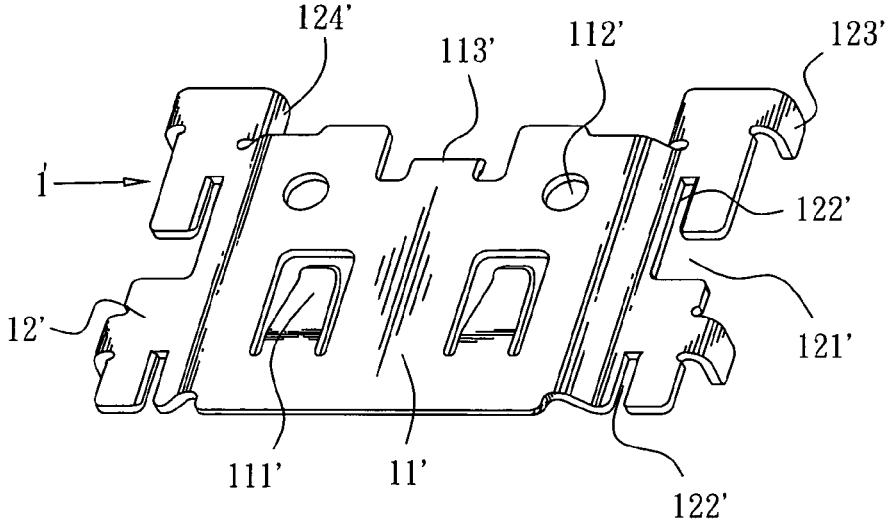
FIG. 6 is a perspective view of an upper shell of a shield of the connector shown in FIG. 5.
Figure 7:
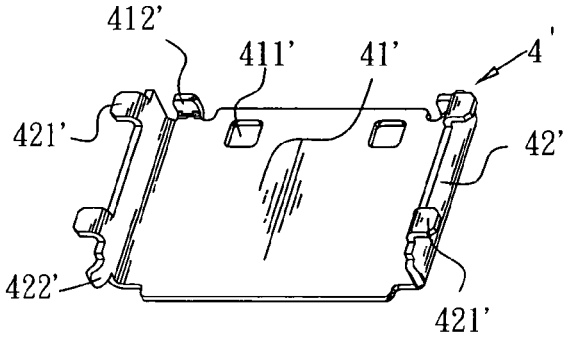
FIG. 7 is a perspective view of a lower shell of the shield of the connector shown in FIG. 5.
Figure 8:
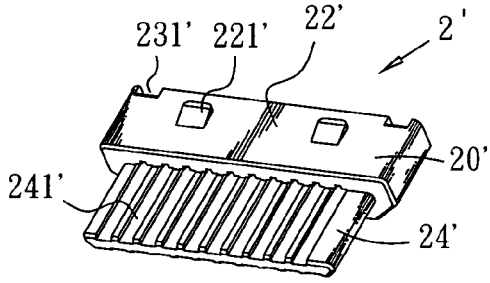
FIG. 8 is a perspective view of an insulating housing of the connector shown in FIG. 5 seen from a bottom angle.
Figure 9:
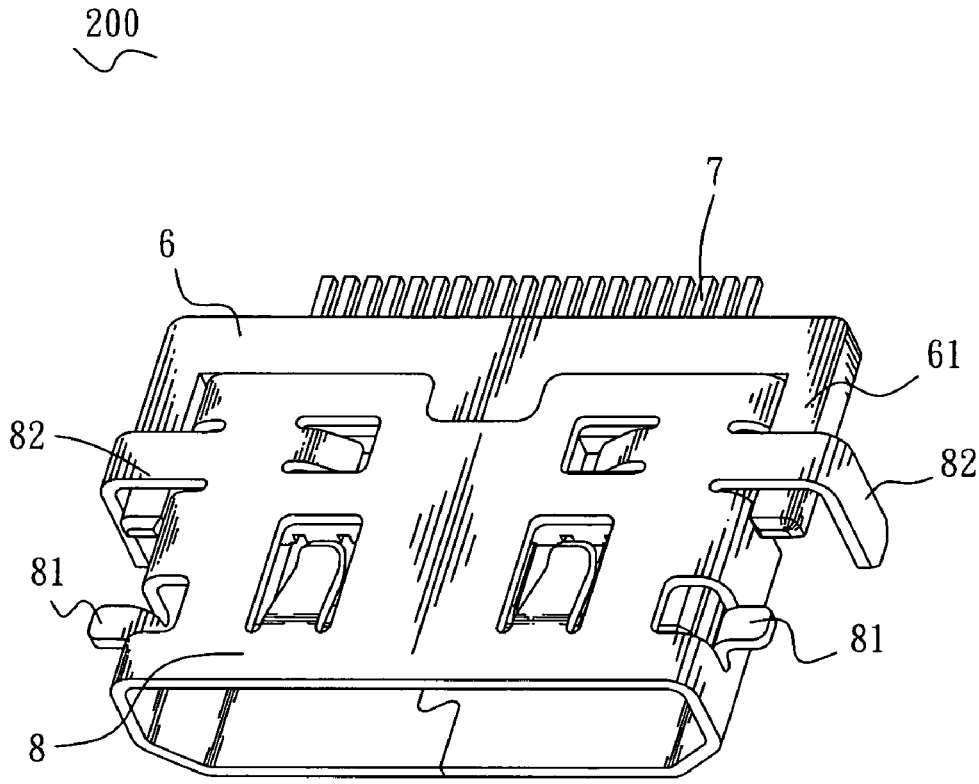
FIG. 9 Prior Art
FIG. 9 is an assembled, perspective view of a connector in prior art.

Referring to FIGS. 1-2 in conjunction with FIG. 4, the shield 5 includes an upper shell 1 and a lower shell 4. The upper shell 1 has an upper cover 11 of rectangular shape and two lateral wings 12 extending laterally from two opposite sides of the upper cover 11. The upper cover 11 is machined, maybe by punch method, to form two elastic slices 111 for abutting an inserted complementary component (not shown), and two fixing holes 112 corresponding to the protrusions 212. A rear end of the upper cover 11 is bent downwards to form a restraining tab 113, corresponding to the restraining slot 211. Each of the wings 12 has two leading openings 121 and two open slots 122, each of which extends frontward from a portion of a front side of the corresponding leading opening 121 adjacent to the upper cover 11. Two positioning pegs 123 are extended downwards from a lateral edge of the wing 12, spaced away from each other, for positioning the connector 100 to the PCB. In this embodiment, a rear end of the wing 12 is rearward of the rear end of the upper cover 11. A blocking plate 124 is extended downwards from an inner edge of the rear end of the wing 12, facing and spaced away from soldering portions of the terminals 3 exposed outside the basic body 20.

The lower shell 4 has a lower cover 41 and a pair of lateral plates 42 extending upwards from two opposite sides of the lower cover 41. The lower cover 41 is of rectangular shape and has a buckling slice 411 corresponding to the buckling groove 221. A rear edge of the lower cover 41 has portions bent upwards to form two tabs 412 adjacent to the respective lateral plates 42, received in the corresponding recesses 231. Each of the lateral plates 42 has portions extended outwards to form two claspers 421, which pass through the leading openings 121 and are moved in the slots 122 to hook sides of the slots 122. A front end of the lateral plate 42 is bent outwards to form a leading portion 422 for convenient insertion of the complementary component.

Please refer to FIGS. 1-3, in assembly, the insulating housing 2 is placed in the lower shell 4 from a front direction and secured by the lateral plates 42. The buckling slice 411 is inserted into the buckling groove 221 and blocked by the stopper 222 for preventing the insulating housing 2 from moving frontward with respect to the lower shell 4. The tabs 412 are received in the recesses 231 for preventing the insulating housing 2 from moving rearwards with respect to the lower shell 4. The upper shell 1 is positioned to cover the insulating housing 2 from a top direction, with the claspers 421 inserted into the leading openings 121. After moving the upper shell 1 frontward, the claspers 421 are restricted by the slots 122 and hook the sides of the slots 122, to buckle the upper shell 1 with the lower shell 4 together. In this embodiment, the claspers 421 can be soldered on the wings 12 for further fastening the upper shell 1 and the lower shell 4. The fixing holes 112 and the restraining tab 113 are engaged with the protrusions 212 and the restraining slot 211, respectively, for avoiding the upper shell 1 moving with respect to the insulating housing 2.

FIGS. 5-8 illustrate a connector 1' in the second embodiment of the present invention, wherein the structure of the connector 1' in the second embodiment is substantially analogue that of the connector 1 in the first embodiment except the engagement between the upper shell 1' and the lower shell 4', and between the lower shell 4' and the insulating housing 2'. The wing 12' of the upper shell 1' has an indention 121' at a middle portion thereof. Two open slots 122' extend rearwards from a front edge of the wing 12' and a rear side of the indention 121', respectively, adjacent to the upper cover 11'. The lower shell 4' is formed with two buckling holes 411', corresponding to buckling lumps 221' formed on the bottom surface 22' of the insulating housing 2', for preventing the insulating housing 2' from moving with respect to the lower shell 4'. The claspers 421' are positioned to pass through the corresponding indentions 121', and moved rearwards to slide in the slots 122', hooking the sides of the slots 122' for buckling the upper shell 1' with the lower shell 4' together.

It should be noted that the connection structure of the lower shell and the upper shell can be changed for meeting different demands and should not be limited. While the clasper pass through the leading opening or the indention of the wing to hook the sides of the slot, as mentioned above, it is possible to firstly form the vertical clasper. Then the vertical clasper passes through the slot when the upper shell is assembled with the lower shell and is bent laterally to hook the side of the slot. Accordingly, the shape of the clasper also can be altered, as strip shape, and should not be limited.

As described above, the shield is formed by the upper shell and the lower shell. The upper shell has the upper cover covering the insulating housing and wings exceeding the basic body. The lower shell has the lateral plates flanked to the insulating housing and buckling with the upper shell by the claspers hooking the sides of the slots formed on the wings. Furthermore, the positioning pegs are arranged at the sides of the wings. Such structure of the shield is capable of completely coating the insulating housing, without punching openings on the portion attached to the insulating housing for achieving supporting and positioning function. Therefore, the shield is preferable to prevent the connector from EMI problem.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector adapted for electrically connecting with a complementary component inserted therein from a front direction, comprising:

an insulating housing having a basic body;

a plurality of terminals received in the insulating housing; and a shield coupled with the insulating housing comprising an upper shell and a lower shell, the upper shell having an upper cover covering a top surface of the insulating housing and a pair of wings extending laterally from two opposite sides of the upper cover, each of the wings having at least one slot extending along a front-to-rear direction and adjacent to the upper cover, and a plurality of positioning pegs extended downwards from a lateral edge thereof, the lower shell having a lower cover attached to a bottom surface of the basic body, and two lateral plates bent upwards from two opposite sides of the lower cover and flanked to the insulating housing, each of the lateral plates having at least one clasper which passes through the slot of the wing and extends laterally to hook a side of the slot, for buckling the upper shell with the lower shell together.

2. The connector as claimed in claim 1, wherein the wing has a leading opening capable of allowing the clasper to pass therethrough, the slot extends back to the leading opening from a portion of a side of the leading opening adjacent to the upper cover.

3. The connector as claimed in claim 1, wherein the wing has an indention, larger than the clasper, at a substantial middle portion thereof along the front-to-rear direction, the slot extends back to the indention from a portion of a side of the indention adjacent to the upper cover.

4. The connector as claimed in claim 1, wherein the clasper is soldered on the wing for further fastening the upper shell and the lower shell.

5. The connector as claimed in claim 1, wherein the basic body has a restraining slot extending perpendicular to an insertion direction of the complementary component at a top surface thereof, and adjacent to a rear surface thereof, a rear edge of the upper cover is extended downwards to form a restraining tab inserted into the restraining slot for fixing the upper shell and the insulating housing.

6. The connector as claimed in claim 1, wherein the basic body has two circle protrusions at a top surface thereof, the upper cover is formed with two fixing holes corresponding to the protrusions for fixing the upper shell and the insulating housing.

7. The connector as claimed in claim 1, wherein the bottom surface of the basic body is projected to form two buckling lumps, the lower cover is formed with two buckling holes mated with the buckling lumps for preventing the insulating housing from moving with respect to the lower shell.

8. The connector as claimed in claim 1, wherein the bottom surface of the basic body has a buckling groove extending along the front-to-rear direction at a middle portion thereof, and a wedge-shaped stopper disposed at a rear end of the buckling groove, the lower cover has a buckling slice which is inserted into the buckling groove and blocked by the stopper for preventing the insulating housing from moving with respect to the lower shell.

9. The connector as claimed in claim 8, wherein the rear surface of the basic body is formed with two recesses reaching the bottom surface, a rear edge of the lower cover is extended downwards to form two tabs received in the corresponding recesses for preventing the insulating housing from moving with respect to the lower shell.

* * * * *